US009074547B2

(12) United States Patent
Li et al.

(10) Patent No.: US 9,074,547 B2
(45) Date of Patent: Jul. 7, 2015

(54) METHOD FOR ADAPTING THE ACTUAL INJECTION QUANTITY, INJECTION DEVICE AND INTERNAL COMBUSTION ENGINE

(75) Inventors: Hui Li, Regensburg (DE); Christian Hauser, Lappersdorf (DE); Joachim Engelmann, Cham (DE); Armin Stolz, Regendorf (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 340 days.

(21) Appl. No.: 13/639,567

(22) PCT Filed: Apr. 6, 2011

(86) PCT No.: PCT/EP2011/055306

§ 371 (c)(1), (2), (4) Date: Oct. 5, 2012

(87) PCT Pub. No.: WO2011/124584

PCT Pub. Date: Oct. 13, 2011

(65) Prior Publication Data

US 2013/0024098 A1 Jan. 24, 2013

(30) Foreign Application Priority Data

Apr. 9, 2010 (DE) ..... 10 2010 014 320

(51) Int. Cl.
*F02D 41/26* (2006.01)
*F02D 41/30* (2006.01)
(Continued)

(52) U.S. Cl.
CPC ..... *F02D 41/1497* (2013.01); *F02D 41/0085* (2013.01); *F02D 41/2438* (2013.01); *F02D 41/2441* (2013.01); *F02D 41/247* (2013.01); *F02D 41/402* (2013.01)

(58) Field of Classification Search
CPC ..... F02D 41/1497; F02D 41/402; F02D 41/2438; F02D 41/2441
USPC ..... 701/104, 110; 123/436, 299, 300, 480, 123/492; 73/114.05, 114.24
See application file for complete search history.

(56) References Cited

U.S. PATENT DOCUMENTS 5,385,129 A * 1/1995 Eyberg ..... 123/436
6,085,143 A * 7/2000 Przymusinski et al. ..... 701/110
(Continued)

FOREIGN PATENT DOCUMENTS

DE 19700711 A1 9/1998 ..... F02D 41/00
DE 10257686 A1 7/2004 ..... F02D 41/12
(Continued)

OTHER PUBLICATIONS

German Office Action, Application No. 10 2010 014 320.0-26, 5 pages, Oct. 18, 2010.
(Continued)

*Primary Examiner* — Hai Huynh
(74) *Attorney, Agent, or Firm* — Slayden Grubert Beard PLLC

(57) ABSTRACT

A method for adapting the actual injection quantity of an injector of an internal combustion engine to the target injection quantity, an injection device for an internal combustion engine, and an internal combustion engine are provided. In the method, the crankshaft acceleration achieved by a test injection pulse is detected in the rotational speed signal of the internal combustion engine and on this basis the injected fuel quantity of the injector is determined. On the basis of the determined injected fuel quantity, the actuating data of the injector of the internal combustion engine is corrected. To this end, the injected fuel quantity of the injector is detected and corrected by a test injection pulse during the normal fired operational state of the internal combustion engine.

18 Claims, 3 Drawing Sheets

(51) Int. Cl.

| | |
|---|---|
| ***F02D 41/14*** | (2006.01) |
| ***F02D 41/24*** | (2006.01) |
| *F02D 41/00* | (2006.01) |
| *F02D 41/40* | (2006.01) |

(56) References Cited

U.S. PATENT DOCUMENTS

| | | | | |
|---|---|---|---|---|
| 6,513,496 | B2 * | 2/2003 | Yomogida | 123/436 |
| 7,139,657 | B2 | 11/2006 | Bouchain et al. | 701/104 |
| 7,392,789 | B2 * | 7/2008 | Dietl et al. | 123/436 |
| 8,141,540 | B2 * | 3/2012 | Wagner et al. | 123/436 |
| 2013/0024098 | A1 | 1/2013 | Li et al. | 701/104 |
| 2013/0325298 | A1 * | 12/2013 | Li et al. | 701/104 |

FOREIGN PATENT DOCUMENTS

| | | | | |
|---|---|---|---|---|
| DE | 10305523 | A1 | 8/2004 | F02D 41/22 |
| DE | 102005052024 | A1 | 5/2006 | F02D 41/40 |
| EP | 1388661 | A2 | 2/2004 | F02D 41/14 |
| EP | 2039917 | A2 | 3/2009 | F02D 41/12 |
| GB | 2498783 | A * | 7/2013 | F02D 41/40 |
| GB | 2500890 | A * | 10/2013 | F02D 41/30 |
| WO | 2011/124584 | A1 | 10/2011 | F02D 41/14 |

OTHER PUBLICATIONS

International Search Report and Written Opinion, Application No. PCT/EP2011/055306, 16 pages, Jul. 28, 2011.

* cited by examiner

METHOD FOR ADAPTING THE ACTUAL INJECTION QUANTITY, INJECTION DEVICE AND INTERNAL COMBUSTION ENGINE

CROSS-REFERENCE TO RELATED APPLICATIONS

This application is a U.S. National Stage Application of International Application No. PCT/EP2011/055306 filed Apr. 6, 2011, which designates the United States of America, and claims priority to DE Application No. 10 2010 014 320.9 filed Apr. 9, 2010, the contents of which are hereby incorporated by reference in their entirety.

TECHNICAL FIELD

The present disclosure relates to a method for adapting the actual injection quantity of an injector of an internal combustion engine to the setpoint injection quantity, in which method the crankshaft acceleration which is achieved by a test injection pulse is detected in the rotational speed signal of the internal combustion engine and, herefrom, the injected fuel quantity of the injector is determined, and in which method the actuation data of the injector of the internal combustion engine are corrected on the basis of the determined injected fuel quantity.

The disclosure also relates to an injection device and to an internal combustion engine.

Embodiments of the method can be used, for example, in internal combustion engines with what are known as common rail injection systems, in which a plurality of, typically all, injection valves are supplied by way of a common fuel line which is under a largely uniformly high pressure. Here, the injection quantities which are to be injected in each case into each cylinder of the internal combustion engine at the beginning of a working cycle are typically metered primarily by the fact that the injection valves or injectors are actuated with an actuation duration which is selected to be shorter or longer, during which actuation duration said injection valves are opened and allow fuel to penetrate into the respective cylinder.

BACKGROUND

A need to adapt injection quantities which are actually injected to setpoint injection quantities which depend on a respective operating state of the internal combustion engine typically results, for example, from temporal changes of properties of the injection valves or injectors.

Thus, in particular, wear phenomena or deposits can lead to injection parameters, such as the actual opening duration or the actual opening degree of the injection valves, and therefore the actual injection quantity changing during the service life of the injection valves.

In order to adhere to the strict emission standards and to make low fuel consumption possible, the injection system of an internal combustion engine has to be capable, however, of injecting a defined fuel quantity exactly over the entire service life of a corresponding injection valve. Nowadays, very high requirements are made of the stability and accuracy of the injection.

It is therefore essential to compensate for the above-described drift of properties of an injection valve during its service life. To this end, it is known to carry out an adaptation of the injection parameters using the crankshaft/engine speed signal. When combustion occurs in the internal combustion engine, an acceleration of the crankshaft of the internal combustion engine occurs. This acceleration can be detected in the speed signal of the internal combustion engine. The actually injected fuel quantity can be determined from this.

Here, the procedure is in detail such that, during a phase (fuel shut-off phase), during which no injection takes place, a test injection pulse is realized and the acceleration, brought about as a result, of the engine speed is determined and is used as an indication for the actually injected fuel quantity. The actuation data of the injector of the internal combustion engine are then corrected on the basis of the determined actually injected fuel quantity.

However, relatively new vehicles have such phases, in which no injection takes place, to a much smaller extent. This means that the corresponding adaptation or correction of the actuation data is slowed down dramatically. The desired emission standards and the desired low fuel consumption can therefore be optimized only insufficiently in this case. The known solutions, in which a single test pulse is used during a fuel shut-off phase, are therefore in need of improvement.

SUMMARY

In one embodiment, a method is provided for adapting the actual injection quantity of an injector of an internal combustion engine to the setpoint injection quantity, in which method the crankshaft acceleration which is achieved by a test injection pulse is detected in the rotational speed signal of the internal combustion engine and, herefrom, the injected fuel quantity of the injector is determined, and in which method the actuation data of the injector of the internal combustion engine are corrected on the basis of the determined injected fuel quantity, characterized in that the injected fuel quantity of the injector is detected and corrected by way of a test injection pulse during the normal combustion operating state of the internal combustion engine (during the normal ignition phase).

In a further embodiment, the detection is carried out during an idling phase of the internal combustion engine. In a further embodiment, the detection is carried out in the disengaged state of the internal combustion engine. In a further embodiment, the detection is carried out by way of a comparison of a normal injection cycle with a test cycle which corresponds to the normal injection cycle and at least one additional defined test pulse. In a further embodiment, the detection is carried out by way of a comparison of two cycles with different test injections. In a further embodiment, the test cycle is carried out as a copy of the configuration of the normal injection cycle at least in one segment and at least one additional defined test pulse. In a further embodiment, the test cycle is carried out as a copy of the configuration of the normal injection cycle, which is defined by the speed controller, in particular the idling speed controller, and at least one additional defined test pulse, by the speed controller, in particular idling speed controller, being "frozen" for the test cycle. In a further embodiment, the injection cycle is divided into n segments and the fuel quantity which is injected by the test pulse is determined from the difference of the speed or acceleration signal of the first n segments and that of the following n segments. In a further embodiment, a combustion signal is determined for the test pulse by way of a comparison of the speed or acceleration signal before and after the test pulse. In a further embodiment, a statistically relevant value, in particular the mean value, is obtained from a plurality of combustion signals. In a further embodiment, the actually injected fuel quantity is determined from the combustion signal or the statistically relevant value of the combustion signals.

In another embodiment, an injection device for an internal combustion engine is provided, which injection device comprises a controller for injection valves of the internal combustion engine, the controller being configured in terms of programming technology for carrying out any of the methods disclosed above. In another embodiment, an internal combustion engine include such an injection device.

BRIEF DESCRIPTION OF THE DRAWINGS

Example embodiments will be explained in more detail below with reference to figures, in which.

DETAILED DESCRIPTION

Figure 1:
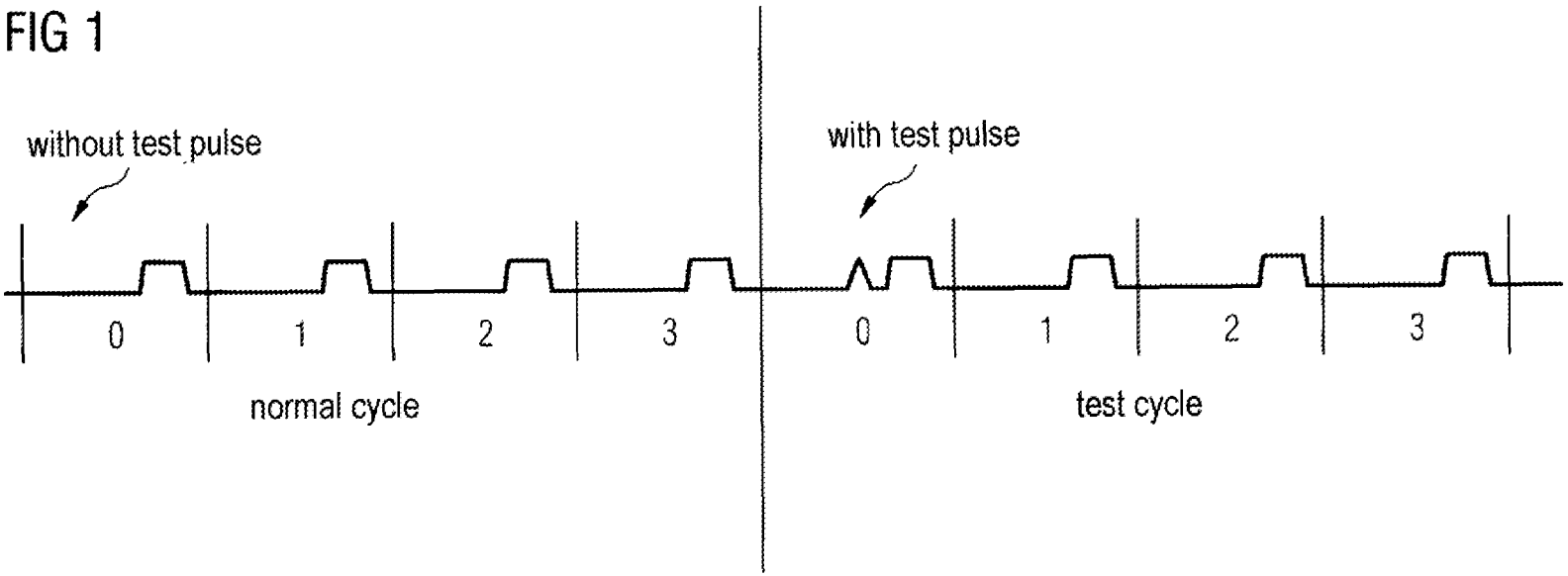
FIG. 1 shows a schematic illustration of examples of injection configurations.

Embodiments of the present disclosure provide a method as described above, which may provide particularly rapid correction or adaptation of the actuation data of an injector of an internal combustion engine.

In some embodiments, the injected fuel quantity of the injector is detected and corrected by way of a test injection pulse during the normal combustion operating state of the internal combustion engine (during the normal ignition phase).

In this manner, an online adaptation of at least one injection control parameter may thus be carried out.

In the disclosed method, the actually injected fuel quantity is not detected during a phase (fuel shut-off phase), during which no injection takes place, but rather is determined and corrected during the normal combustion operating state of the internal combustion engine (during the normal ignition phase). The method may therefore be suitable for all vehicle types, since the normal combustion operating state is always present. The adaptation or correction of the actuation data of the injector can be carried out very rapidly.

The detection of the actually injected fuel quantity may be carried out during an idling phase of the internal combustion engine and/or in the disengaged state of the latter. As a result of the detection in the disengaged state, corresponding outlay on calibration for different transmission types may be avoided.

In a first variant, the detection of the injected fuel quantity is carried out by a comparison of a normal injection cycle with a test cycle which corresponds to the normal injection cycle and at least one additional defined test pulse. Here, an injection configuration is specifically set which has alternating injection patterns with and without test pulses. Here, the normal injection cycle is stipulated by the requirement of the driver or by a control unit. The test cycle is a copy of the normal injection cycle with one or more additional test pulses. Both cycles are compared with one another, the difference of both cycles representing an indication for the injected fuel quantity. Absolute fuel quantities can be determined by way of this method.

In a second variant, the detection is carried out by way of a comparison of two cycles with different test injections. A first injection cycle has one or more defined test pulses. The second cycle likewise has one or more defined test pulses. Differences in the injected fuel quantities can be determined from the difference of the cycles.

The test cycle may be carried out as a copy of the configuration of the normal injection cycle, which is defined by the speed controller, with at least one additional defined test pulse, by the speed controller being "frozen" for the test cycle at least in one segment. This may be carried out when the internal combustion engine is in a control phase of a constant idling speed, that is to say at least the injection parameters in the test segment correspond to the parameters of the last combustion cycle, apart from the defined test injection pulse. Depending on the signal profile and the evaluation, the parameters for further segments are copied from the preceding cycle.

The injection cycle may be divided into n segments, and the fuel quantity which is injected by the test pulse is determined from the difference of the speed or acceleration signal of the first n segments and that of the following n segments, n may correspond to the number of cylinders.

In one embodiment of the method, a combustion signal for the test pulse is determined by way of a comparison of the speed or acceleration signal before and after the test pulse, which combustion signal corresponds to the effect which is achieved by the test pulse or to the corresponding combustion. In particular, a statistically relevant value, specifically the mean value, is obtained from a plurality of combustion signals. The actually injected fuel quantity is then determined from the combustion signal or the statistically relevant value of the combustion signals. With the aid of the determined actually injected fuel quantity, the actuation data of the injector or the injectors of the internal combustion engine are then corrected or adapted in such a way that the defined fuel quantity or setpoint fuel quantity is injected exactly over the service life of the injector.

Other embodiments provide an injection device for an internal combustion engine, which injection device comprises a controller for injection valves of the internal combustion engine, the controller being configured in terms of programming technology for carrying out any of the methods disclosed herein. Other embodiments provide an internal combustion engine which comprises an injection device as disclosed herein.

In one embodiment, a test injection is carried out while the internal combustion engine is in a control phase at a constant idling speed. FIG. 1 shows the injection configurations at the idling speed with and without test pulse. The normal injection cycle is defined by the idling speed controller. The injection test cycle which is carried out is a copy of the injection configuration during the normal injection cycle (that is to say, injection times, injection position, etc.) with an additional test pulse. This means that the idling speed controller is "frozen" for the test cycle, that is to say that the injection parameters of all the injection pulses correspond to the parameters of the last combustion cycle, apart from the defined test injection pulse.

For the internal combustion engine with four cylinders which is described here, a combustion cycle has four segments. The difference between the first four segments and the following four segments corresponds exactly to the test pulse. The combustion which is produced by the test pulse can be determined or calculated by way of a comparison of the speed signal or acceleration signal of the internal combustion engine for the first four segments with that of the following four segments.

For example, a plurality of test pulses are carried out at the idling speed.

On the left-hand side, FIG. 1 shows the injection pattern in the normal cycle (with active controller) and, on the righthand side, the injection pattern in the test cycle (with "frozen" controller) over in each case four segments. In contrast to the normal cycle, there is a test pulse in segment 0. Otherwise, there are identical parameters for identical segments.

Figure 2:
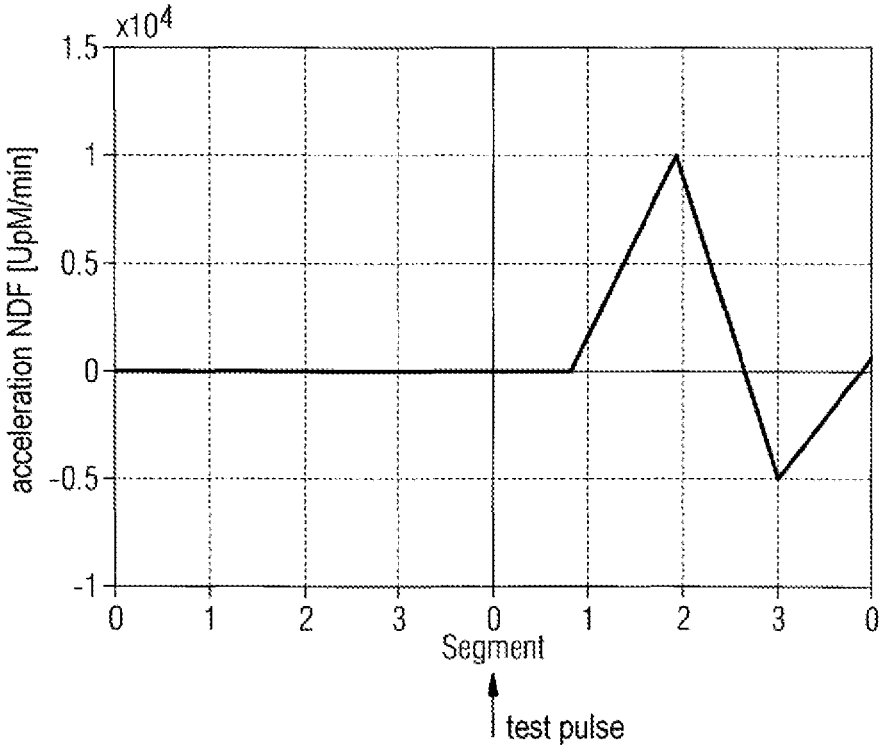
FIG. 2 shows a diagram which shows one example of the acceleration which is achieved by a test pulse.

FIG. 2 shows a schematic illustration of a curve which represents one example of an acceleration signal N DF which is calculated from a test pulse. As mentioned, a test pulse is output and realized in segment 0. The acceleration and deceleration of the crankshaft can be determined in segments 2 and 3. The "effect" which is produced by the test pulse or the combustion which is brought about as a result can be determined by way of a comparison of the acceleration signal before and after the test pulse.

In order to configure the "combustion signal", the following calculation method can be applied:

$$SIG_CMB=(a_1 \cdot N_DF(0)+a_2 \cdot N_DF(1)+a_3 \cdot N_DF(2)+a_4 \cdot N_DF(3))$$

Sum of N_DF after test pulse $$-(a_5 \cdot N_DF(0)+a_6 \cdot N_DF(1)+a_7 \cdot N_DF(2)+a_8 \cdot N_DF(3))$$

Sum of N_DF before test pulse

Here, N_DF(0) to N_DF(3) represent the acceleration values to be assigned to segments 0-3.

The values $a_1 \ldots a_8$ represent loading parameters which are configured depending on the occurrence of the acceleration and deceleration in the corresponding segment.

Figure 3:
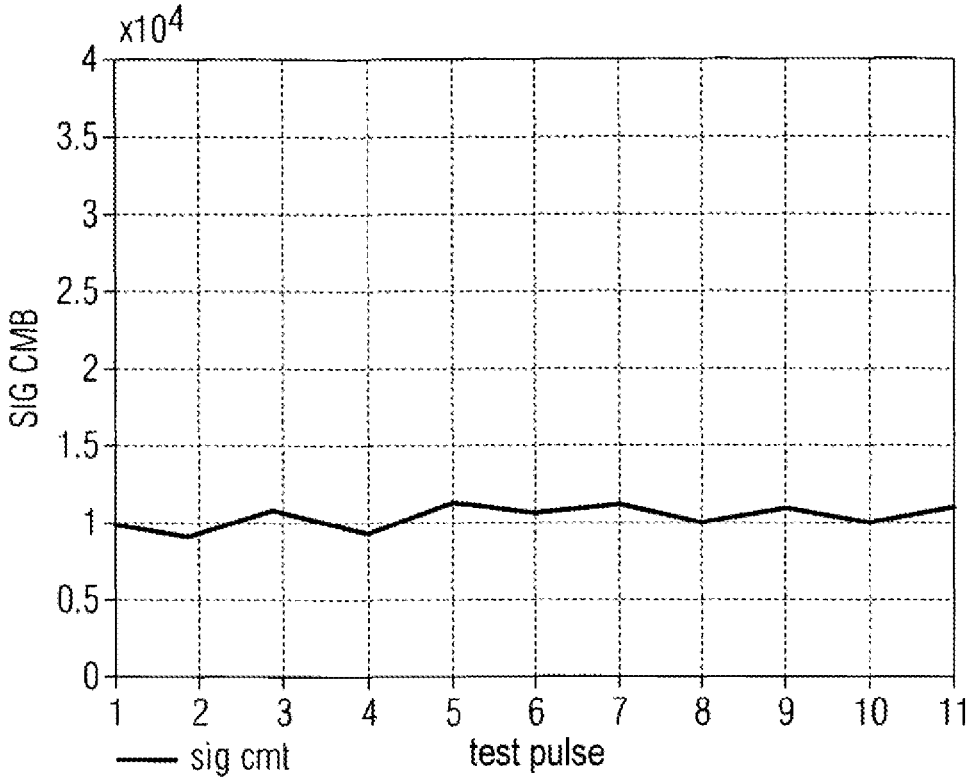
FIG. 3 shows a diagram which shows a calculated combustion signal for test pulses.

FIG. 3 shows the combustion signal SIG CMB, calculated according to the above equation, for the different test pulses, which combustion signal SIG CMB has been determined according to the described method. In order to achieve a more reliable result, filtering methods or mean value determination methods can be used. The statistical combustion value sig_cmb_mean can be calculated by simple mean value formation after elimination of the maximum and minimum.

The relationship or correlation between the values sig_cmb_mean and an actually injected fuel quantity is known, since it can be determined experimentally. The actuation data of the corresponding injector of the internal combustion engine are then corrected on the basis of the determined actually injected fuel quantity.

Figure 4:
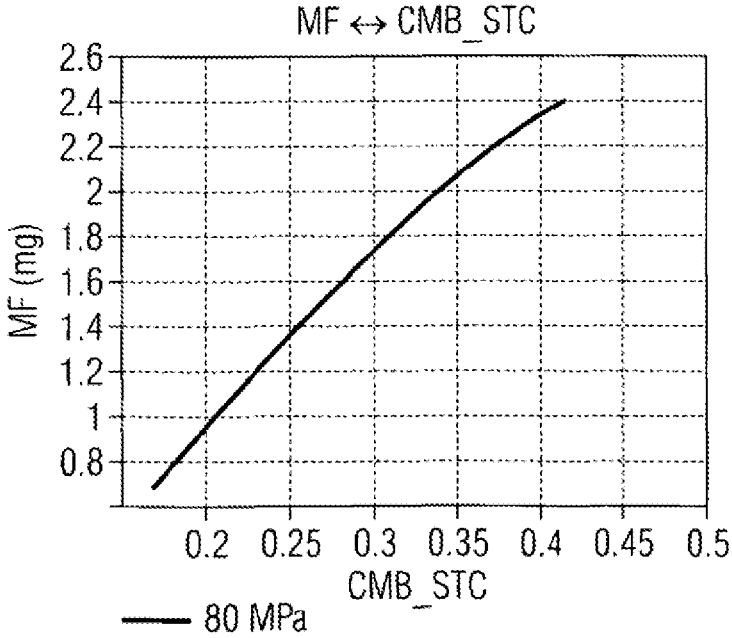
FIG. 4 shows a diagram which schematically shows the injected fuel quantity as a function of combustion signals.

Purely by way of example for clarity, FIG. 4 shows the relationship between calculated combustion values CMB_STC and the respective actually injected fuel quantity MF for a pressure of 80 MPa.

The invention claimed is:

1. A method for regulating fuel injection quantities of an injector of an internal combustion engine, comprising:

implementing a test cycle including a test injection pulse during a normal fired combustion operating state of the internal combustion engine, detecting a rotational speed signal of the internal combustion engine caused by the test injection pulse, using a processor, determining a crankshaft acceleration based on the detected rotational speed signal caused by the test injection pulse, using the processor, determining an actual injected fuel quantity of the injector based on the determined crankshaft acceleration associated with the test injection pulse, and using the processor, adjusting actuation data of the injector for subsequent fuel injections based on the determined actual injected fuel quantity.

2. The method of claim 1, wherein the test cycle is implemented during an idling phase of the internal combustion engine.

3. The method of claim 1, wherein the test cycle pulse is implemented in a disengaged state of the internal combustion engine.

4. The method of claim 1, wherein the test cycle corresponds to a normal injection cycle plus the test injection pulse, and wherein the actual injected fuel quantity is determined by comparing the test cycle with the normal injection cycle.

5. The method of claim 4, wherein a combustion signal is determined for the test injection pulse by comparing a speed or acceleration signal before the test injection pulse with a speed or acceleration signal after the test injection pulse.

6. The method of claim 5, wherein a mean value is calculated from a plurality of combustion signals.

7. The method of claim 5, wherein the actually injected fuel quantity is determined from the combustion signal or the mean value of the combustion signals.

8. The method of claim 1, wherein the actual injected fuel quantity is determined by comparing two test cycles with different test injection pulses.

9. The method of claim 1, wherein the test cycle is executed with the same configuration as a normal injection cycle at least in one segment of a combustion cycle and includes the test injection pulse in another segment of the combustion cycle.

10. The method of claim 9, wherein the test cycle is executed with the same configuration as a normal injection cycle defined by an idling speed controller, plus with the test injection pulse, wherein the during the test cycle, all injection pulses other than the test injection pulse are controlled using injection parameters corresponding to injection parameters used during a combustion cycle preceding the test cycle.

11. The method of claim 1, wherein the injection cycle is divided into n segments and the fuel quantity which is injected by the test injection pulse is determined from the difference of the speed or acceleration signal of the first n segments and that of the following n segments.

12. An injection device for an internal combustion engine, comprising:

a controller for injection valves of the internal combustion engine, the controller programmed to:

implement a test injection pulse during a normal fired combustion operating state of the internal combustion engine, detect a rotational speed signal of the internal combustion engine caused by the test injection pulse, determine a crankshaft acceleration based on the detected rotational speed signal caused by the test injection pulse, determine an actual injected fuel quantity based on the determined crankshaft acceleration associated with the test injection pulse, and adjust actuation data for subsequent fuel injections of at least one of the injection valves based on the determined actual injected fuel quantity.

13. The injection device of claim 12, wherein the test cycle is implemented during an idling phase of the internal combustion engine.

14. The injection device of claim 12, wherein the test cycle pulse is implemented in a disengaged state of the internal combustion engine.

15. The injection device of claim 12, wherein the test cycle corresponds to a normal injection cycle plus the test injection pulse, and wherein the actual injected fuel quantity is determined by comparing the test cycle with the normal injection cycle.

16. The injection device of claim 12, wherein the actual injected fuel quantity is determined by comparing two test cycles with different test injection pulses.

17. The injection device of claim 12, wherein the test cycle is executed with the same configuration as a normal injection cycle at least in one segment of a combustion cycle and includes the test injection pulse in another segment of the combustion cycle.

18. The injection device of claim 12, wherein a combustion signal is determined for the test injection pulse by comparing a speed or acceleration signal before the test injection pulse with a speed or acceleration signal after the test injection pulse.

* * * * *